US006160765A

United States Patent [19]

Schober

[11] Patent Number: 6,160,765

[45] Date of Patent: Dec. 12, 2000

[54] DEVICE FOR DETERMINING THE INITIAL DATE OF ACTIVATION OF A UNIT OF EQUIPMENT

[75] Inventor: Klaus Schober, Karlsruhe, Germany

[73] Assignee: International Business Machines Corporation, Armonk, N.Y.

[21] Appl. No.: 08/984,880

[22] Filed: Dec. 4, 1997

[30] Foreign Application Priority Data

Dec. 13, 1996 [DE] Germany ..... 196 51 995

[51] Int. Cl.[7] ..... G04F 10/00; G04F 8/00; G04B 19/24; H01H 3/00

[52] U.S. Cl. ..... 368/9; 368/28; 368/113; 307/139

[58] Field of Search ..... 368/1, 5, 6, 8–10, 368/107–113; 307/141, 141.4, 139, 140; 340/309.15, 309.4

[56] References Cited

U.S. PATENT DOCUMENTS

| | | | |
|---|---|---|---|
| 3,182,440 | 5/1965 | Widegren | 368/9 |
| 3,221,489 | 12/1965 | Mackey et al. | 368/9 |
| 3,256,685 | 6/1966 | Siewert | 368/10 |
| 3,735,081 | 5/1973 | Foerstner | 368/9 |
| 4,624,578 | 11/1986 | Green | 368/10 |
| 4,912,687 | 3/1990 | Treert | 368/107 |
| 5,003,518 | 3/1991 | Felder | 368/5 |

*Primary Examiner*—Vit Miska
*Attorney, Agent, or Firm*—George E. Grosser; Andrew Dillon

[57] ABSTRACT

A device for the determination of the elapsed time since the initial activation of a unit of equipment. The device consists of a first and second circuit and a switch-on element. The first circuit establishes a connection between the item of equipment and the switch-on element. The second circuit consists of at least a time-counter and a source of energy to power the time-counter. Both circuits can be activated simultaneously by the switch-on element. The first circuit can be used both as the current flow for the item of equipment and also for detecting voltage or physical energy in a component of an item of equipment. The switch-on element can be activated both mechanically and electronically. The counter-information can be presented in a display unit in both a deletable or non-deletable manner. The time-counter and the display unit are powered by their own energy source. Because of its simple construction, the present invention can be introduced into any item of equipment after manufacture without any technical adjustments being necessary. Furthermore, it can be used in association with almost any component of an item of equipment.

19 Claims, 4 Drawing Sheets

DEVICE FOR DETERMINING THE INITIAL DATE OF ACTIVATION OF A UNIT OF EQUIPMENT

BACKGROUND OF THE INVENTION

1. Field of the Invention

The present invention consists of a device for determining the elapsed time since an item of equipment was first activated, in particular, an item of equipment of an electrical or electronic nature.

2. Description of the Related Art

When items of electrical or electronic equipment are sold, the purchaser is normally granted a guarantee for the correction of any faults at no cost. If nothing is agreed to the contrary, the guarantee comes into force on the day the equipment is handed over. Consequently the manufacturer, the seller and the purchaser have a legitimate interest in documenting as accurately as possible the day the equipment is handed over or the day on which it is first activated.

The day on which the equipment is handed over is usually determined by the issue of a Guarantee Card with the hand-over date or by a dated receipt for payment. Problems can occur, however, if the issue of a Guarantee Card has been forgotten or the hand-over date has not been entered on the Guarantee Card. A further problem arises if there is no reference on the receipt to the Serial Number of the purchased item of equipment. Burden-of-proof problems affecting both the buyer and the seller are unavoidable. The manufacturers/sellers of equipment, therefore, go through a complex administrative procedure in order to be protected against unjustified claims against guarantee. Each item of equipment is provided with a Serial Number. The seller is obliged to fill out a Guarantee Card for each item sold on which the date of the hand-over and the Serial Number of the item of equipment must be recorded. When several thousand items of equipment are sold—a situation which is not unusual for wholesalers—the mere filling out of the relevant Guarantee Cards requires a very great deal of personnel time.

Moreover, the customers also have to take special administrative measures to ensure that the relevant Guarantee Card is available for each item of equipment. This procedure is very cost intensive in terms of personnel and prone to error.

Disclosure document DE 3428698 describes a device for the definite determination of the date upon which an item of equipment involved in entertainment electronics was first used, such that with the aid of a memory unit and a timing unit a situation is created where the equipment can only be used for the intended purpose if a date is entered. If this action is not carried out, the timing unit interrupts the operation of the equipment after a period of time. A disadvantage of this device is that the unit for determining the date of first activation must be connected to the switching arrangement of the equipment. Provision for this connection must be made at the time the equipment is being developed, or subsequent insertion is practically impossible.

Furthermore, this solution is not customer friendly as the customer is obliged to enter a date in order to prevent equipment being switched off automatically.

It is, therefore, the task of the present invention to propose a device which determines the time which has elapsed since a unit of equipment was first activated, which is simple in construction and operation, and can also be inserted without amendment into almost any other unit of equipment after manufacture. This invention must also determine the time which has elapsed since the equipment was first activated in a customer-friendly manner.

SUMMARY OF THE INVENTION

This task is resolved by features of the Principal Claims. Advantageous versions of the present invention are described in the Subordinate Claims.

A particular advantage of the present invention is that parts of the invented device can be of both a mechanical and an electronic nature. The circuit for activating the time-counter is independent of the current supply to the item of equipment. Consequently any technical malfunctions in the equipment have no influence upon the function of the time-counter. The first activation of the item of equipment does not require the input of a date by the customer. The time-counter commences to run when the equipment is first activated. The elapsed time determined by the time counter since the first activation of the item of equipment can be made visible by a display unit. The present invention can be fitted to almost every component of an item of equipment, whose operating voltage lies within a pre-set range.

BRIEF DESCRIPTION OF THE DRAWINGS

The invention is described in more detail by reference to the following drawings, where FIG. 1 displays an application example of the present invented device in which the switch-on- and switch-off element is of a mechanical nature FIG. 2 displays a further application example of the present invented device in which the switching arrangement consists of a circuit to activate the time-counter and a switch-on element for activating the circuit FIG. 3 displays a further application example of the present invention in which the switch-on element is of an electronic nature FIG. 4 displays a further application example of an electronically-controlled switch-on element.

DESCRIPTION OF THE PREFERRED EMBODIMENT

Figure 1:
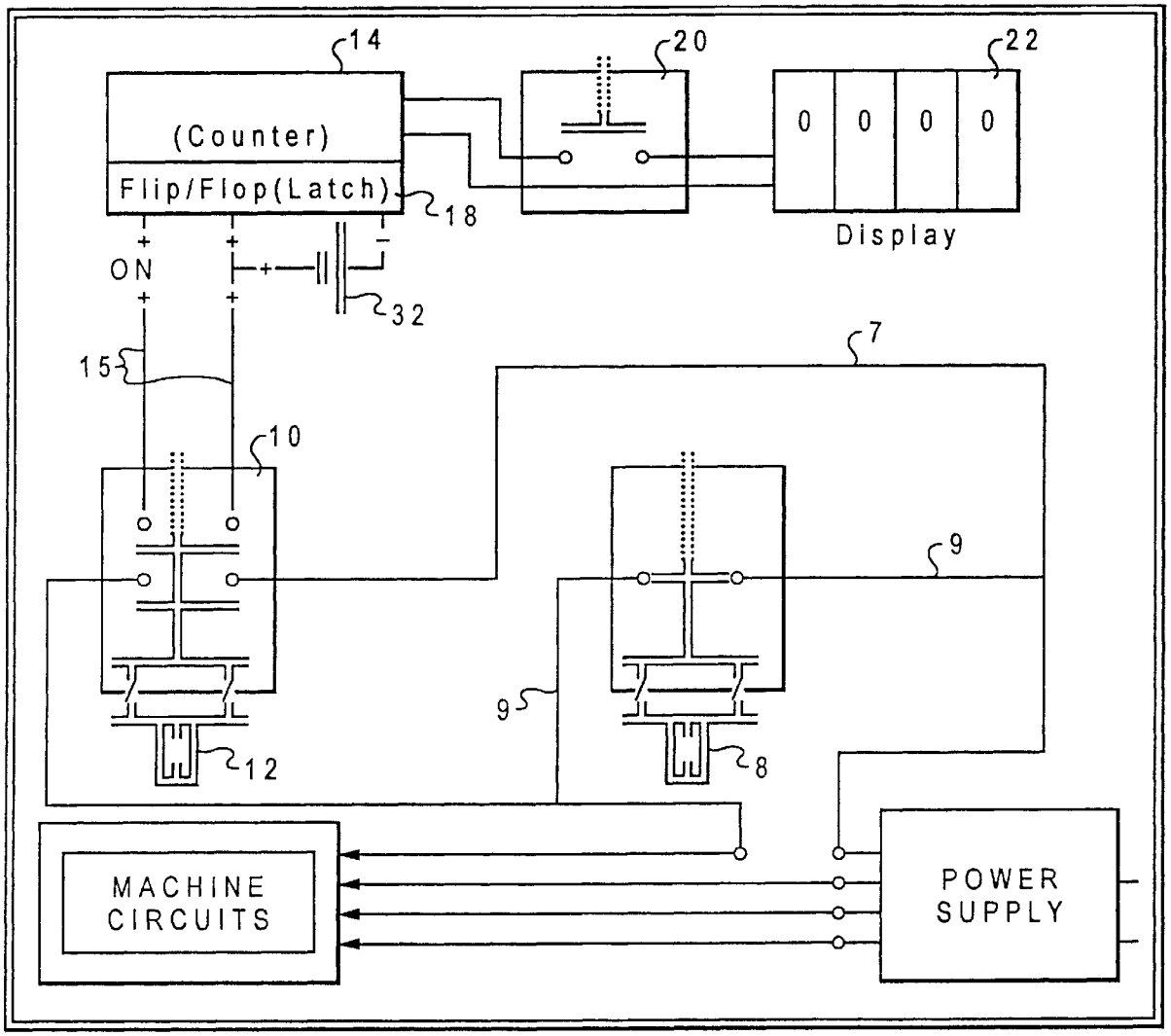

FIG. 1 displays a switching arrangement 1, which consists of a first circuit 7 and a second circuit 15 and a switch-on element 12. The first circuit 7 produces an electrical connection between the device and the switch-on apparatus 12. The second circuit 15 activates a time-counter 14 for the determination of the date of the first activation by the customer or the time which has elapsed since the first activation by the customer. The first circuit 7 and the second circuit 15 can be simultaneously activated by the switch-on element 12. The first circuit 7 and the second circuit 15 are switched independently of one another. In FIG. 1 the first circuit 7 is used as the current circuit to supply the current for the item of equipment. If the switch-on element 12 is not activated, the first circuit 7 is interrupted. No current can then flow. The item of equipment is not capable of operating. If the switch-on element 12 is activated, the first circuit 7 is closed and the device can be supplied with current. At the same time, the switch-on element 12 activates the second circuit 15, which was previously interrupted. This makes it possible for a current to flow from the battery to the time-counter 14, thereby activating the time-counter 14.

In FIG. 1 the first circuit 7 has the additional function of facilitating the Final Test at the conclusion of the assembly of the item of equipment. If the equipment is switched on for testing, a current flows through circuit 9 to the machine circuits. If the device operates in a fault-free manner circuit 9 has to be interrupted. This takes place with the assistance of a switch-off element 8, which preferably takes the form of a switch which can be designed as either a mechanical or an electrical switch. Only a mechanical switch is shown in FIG. 1. The switch-off element 8 forms part of the first circuit 7. A mechanical switch-off element 8 is shown in FIG. 1 and in particular, designed in the form of a mechanical switch which is a one-time switch and in particular a make-or-break switch. Other similar-acting switches which are known to the expert are also possible. This kind of switch 8 ensures that the interrupted current (first circuit 9) can not be closed again. If the current flow of the first circuit 7 is opened by activation of the switch-off element 8, then the item of equipment can only be put into operation if the switch-on element 12 and particularly switch 12 is activated. The switch-on element 12 has a double-function; in the first place it closes the first circuit 7 to operate the device and secondly, it activates the second circuit 15, which activates the time-counter 14 to determine the date of the first activation/duration of the period of operation of the equipment. The switch-on element 12 can be activated either manually or electronically. A mechanical switch is displayed in FIG. 1, which is preferably constructed as a one-time switch and in particular is a make-or-break switch. Other similar acting switches which are known to the expert can be used as well. The sole requirement is the technical certainty that the current flow of the second circuit 15 can not be interrupted again. The second circuit 15 consists of at least a time-counter 14 to determine the time (hours/days) of the first activation of the unit of equipment, and a source of energy 32 which powers the counter. By the activation of the switch-on element 12, the second circuit 15 is activated with the result that the energy source 32, which is a component of the second circuit 15, activates the time counter 14. The energy source 32 takes the form of a battery. However, other similarly working sources of energy known to the expert can be employed. Clocks, and especially digital clocks are suitable as the time counter 14. However, other forms of equipment known to the expert as working in a similar way can be used for the determination of the period of operation of the equipment.

Preferably, the time counter 14 is connected to a display unit 22 in order to make the date of first activation/elapsed time since activation visible. A further version provides that the time counter 14 is connected to the display unit 22 through a switch 20. The switch 20 makes it possible for the display 22 to be visible only upon request. This makes it possible to use a lower capacity unit for energy source 32.

Instead of a digital display a form of display can be installed which at a determined time (month/half year, whole year) causes a burning-in procedure to be initiated, thereby producing a coloured mark. This has the advantage that the battery life is extended and when the battery is dead, the burned-in marks are retained permanently.

In the case of units of equipment having their own internal procedure to read out and display the output of the time-counter 14 it is possible to dispense with the display unit 22. With this version, however, there is the risk that if a fault develops in the term of equipment it might not be possible to read the time-counter.

Even then, it is possible to dispense with a display unit if a read-out device is made available as a tool by the service organization.

The switching arrangement provided by the invention can be installed into an item of equipment or fitted at a later date without any problem. The soft contacts can be soldered to each PCB or connected to another component by sealable cable sleeves. However, inclusion within the circuitry of the unit of equipment is preferable.

Figure 2:
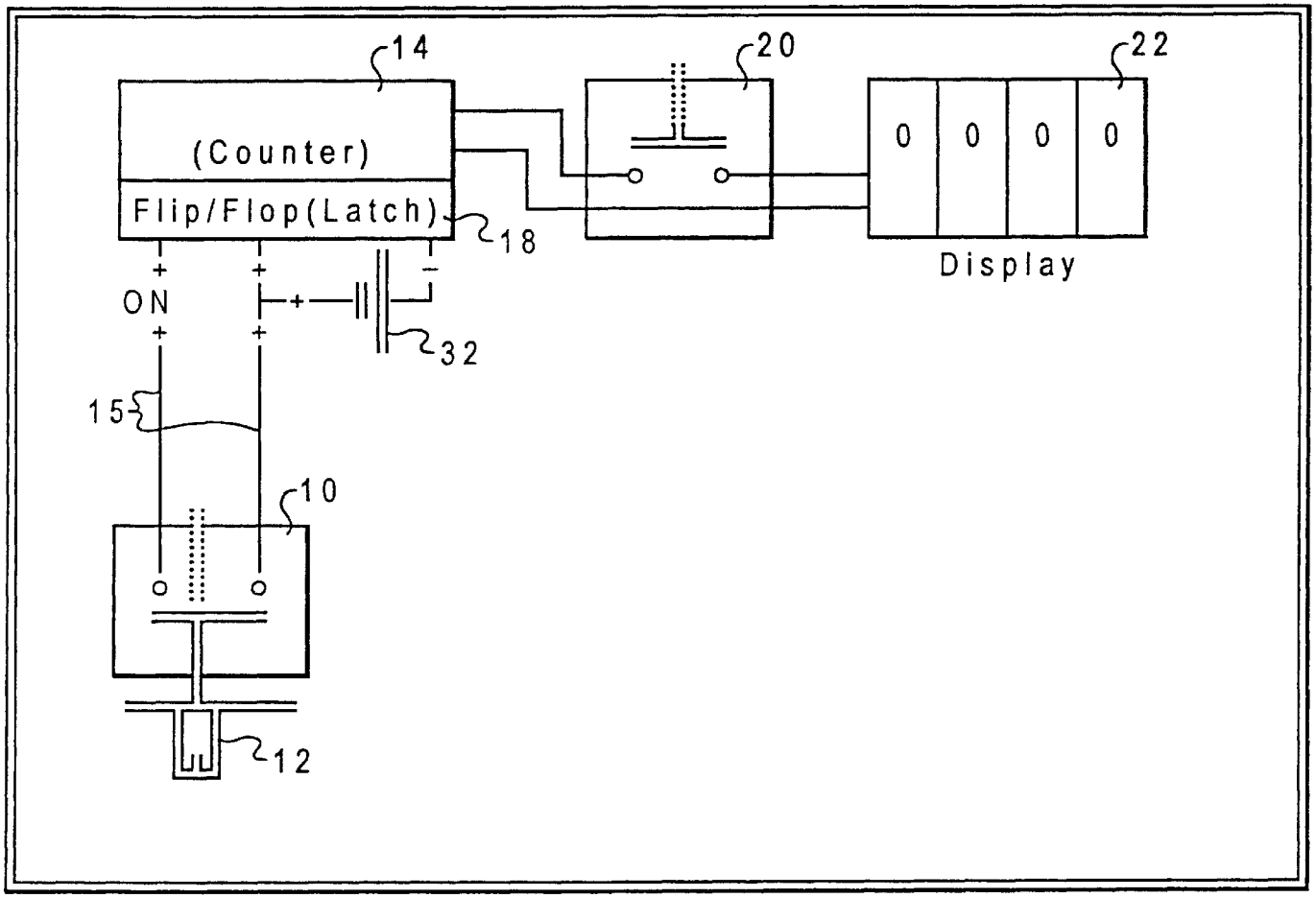

FIG. 2 shows a simplified version of the invented switching arrangement with a circuit 15 to activate the time-counter 14 and the mechanical switching-on device 12. By operation of the switch 12, the second circuit 15 is activated so that the time-counter 14 begins to run. Circuit 12 is automatically activated when the item of equipment is switched on.

Figure 3:
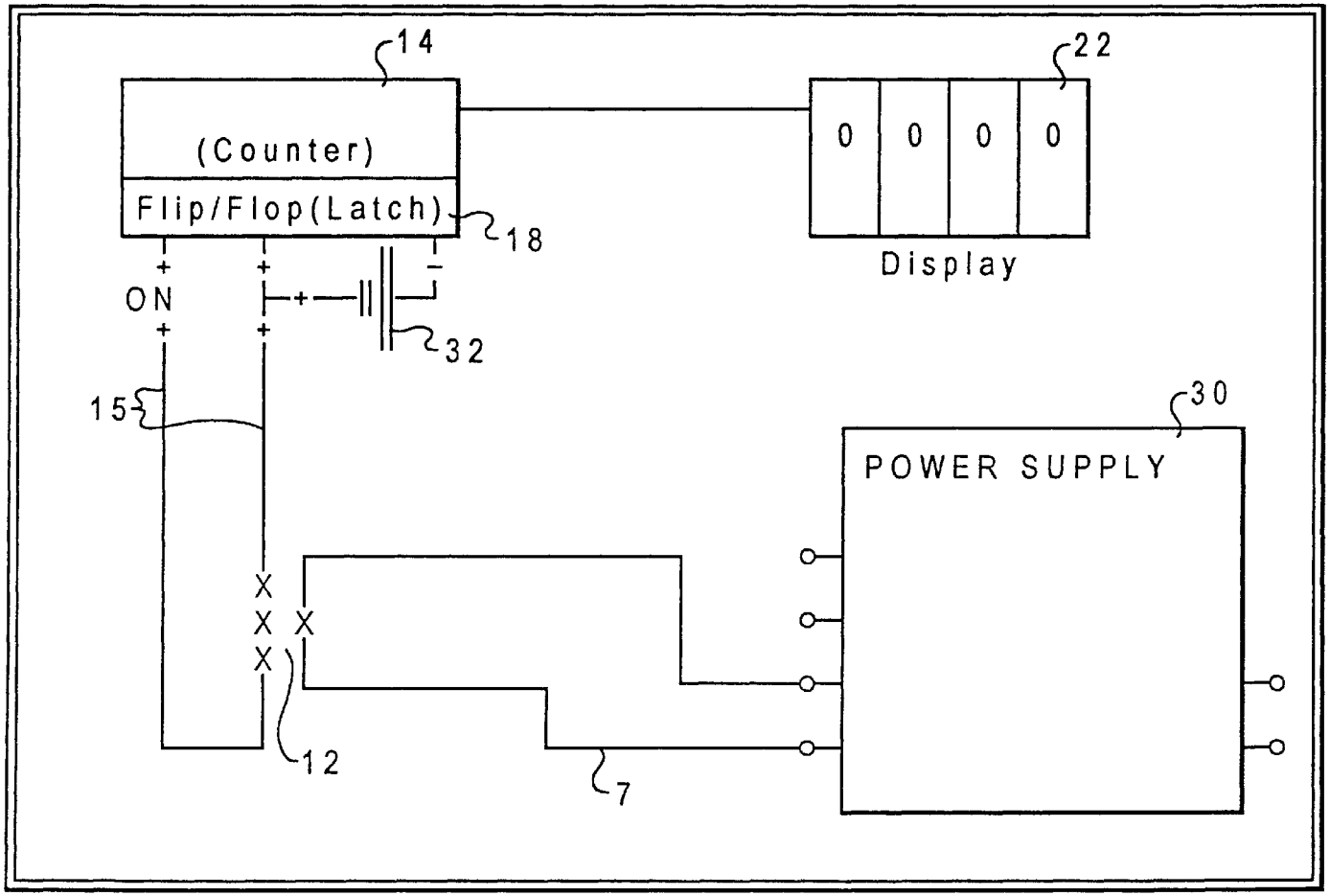

FIG. 3 shows a further version of the present invention where the switch-on element is of an electronic nature.

With this version also, the switch-on element 12 activates the second circuit 15. As distinct from FIG. 1 the first circuit 7 is not interrupted by the switch-on element 12. A current can flow at any time if voltage is applied to the first circuit. In FIG. 3, the first circuit 7 is connected to the current supply unit 30. If the item of equipment is switched on there is a voltage at the current supply unit 30. The current which can now flow through a first circuit 7 activates the switch-on element 12, which then once more activates the second circuit 15. As distinct from the mechanical activation of the second circuit in FIG. 1, the activation of the second circuit in FIG. 3 takes place by a galvanic separation between the switch-on element 12 and the second circuit 15. The second circuit 15 can be activated by the switch-on element 12 by a relay, optical coupler or other means known by the expert to operate in a similar manner. This causes the time-counter 14 to be activated. The energy supply of the time-counter 14 is independent of the current supply of the item of equipment. As a result of this, malfunctions in the current supply to the unit of equipment have no influence on the function of the time-counter 14. Therefore, the time-counter 14 requires its own source of energy, which in this version is a battery 32. If the second circuit 15 is de-activated, e.g. because the current supply is interrupted, the flip-flop (latch) 18 ensures that the time-counter 14 continues to run despite the de-activation of the first circuit 7. If so desired, the information stored in the time-counter 14 can be shown on a display unit 22, stored in a non-deletable memory or retained and presented in another manner known by the expert to operate in a similar manner. For example, one possibility is storage in an EPROM.

A further version (not illustrated) consists of a bridge applied to the first circuit 7 which prevents the second circuit 15 being activated when the item of equipment is being tested. The bridge prevents the current flow being led to the switch-on element. Once the testing had been completed, this bridge must be removed again.

For items of equipment, and in particular for computers, which are given a manufacturing date during the manufacturing process which is stored in a memory and continues to be held there, a further application example is given. In this, on the occasion of the first activation, the current date of that activation of the time of equipment is stored in an EPROM and can be recalled at any time. The EPROM can be read out by means of any appropriate software.

Figure 4:
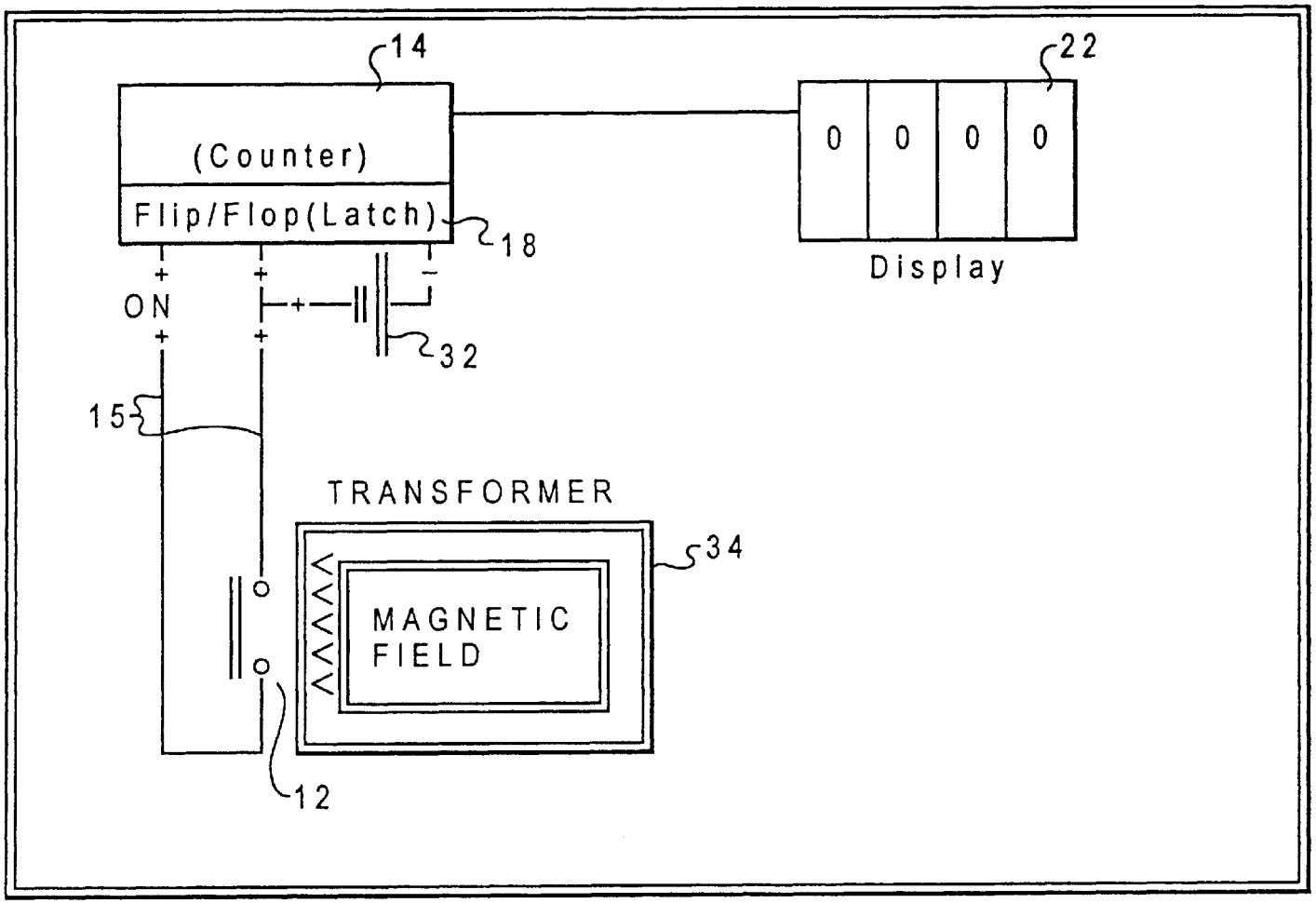

FIG. 4 shows a further version of the present invention where the physical properties of the components and, in particular, magnetic and electrical fields, light, heat, etc. generated by the unit of equipment are used to activate the switch-on element 12 and to close the second circuit 15. In the present example, the present invention is positioned in the immediate vicinity of the transformer 34 of an item of equipment. The transformer 34 develops a magnetic field when the unit of equipment is activated and this is used to activate the switch-on element and to close circuit 15. Here, too, the activation of the circuit 15 results from a galvanic separation of the switch-on element of the circuit as described in FIG. 3.

The present invention can also be used with separately available components of a unit of equipment. Typical examples are, e.g. memory units or adaptor cards, hard discs, etc.

What is claimed is:

1. A device for determining the elapsed period of time since the first activation of a unit of equipment or components of a unit of equipment, particularly a unit of electrical equipment, said device comprising:

a time-counter containing one of a latch or a flip-flop;

an energy source for activating said time-counter;

a first circuit for establishing a connection between said energy source and said time-counter; and a switch-on element for permanently activating said first circuit, such that said first circuit remains active after the end of said first activation of said unit of equipment and remains active throughout subsequent activations of said unit of equipment.

2. A device in accordance with claim 1, further comprising a second circuit for connecting said item of equipment or a component thereof and the switch-on element, wherein the second circuit may be activated by the switch-on element.

3. The device in accordance with claim 2, wherein said first and second circuits are capable of being activated simultaneously by said switch-on element.

4. The device in accordance with claim 2, wherein said second circuit forms part of the current flow of said unit of equipment.

5. The device in accordance with claim 2, wherein said second circuit can be arranged so as to be able to tap a voltage at any chosen electrical or electronic component of said unit of equipment.

6. The device in accordance with claim 2, wherein said second circuit additionally contains a switch-off element to interrupt the current flow.

7. The device in accordance with claim 1, wherein said first circuit also contains a display unit.

8. The device in accordance with claim 7, wherein said first circuit also contains a switch for switching on and off said display unit which presents the time-counter information.

9. The device in accordance with claim 7, wherein the counter-information in said display can be presented in a non-deletable manner.

10. The device in accordance with claim 7, wherein it is possible to store said counter-information in a memory unit in a non-deletable way.

11. The device in accordance with claim 2, wherein said switch-on element is a mechanical switch for the simultaneous activation of said first and/or second circuit.

12. The device in accordance with claim 1, wherein said switch-on element is a mechanical one-time switch and, in particular a make-or-break switch.

13. The device in accordance with claim 1, wherein said switch-on element is galvanically separated from the first circuit.

14. The device in accordance with claim 1, wherein said first circuit can be activated by the switch-on element by means of a relay or optical-coupler.

15. The device in accordance with claim 2, wherein said second circuit contains an electrical bridge to prevent an activation of said switch-on element.

16. The device in accordance with claim 2, wherein said switch-on element can be activated by the physical properties of a component of the item of equipment.

17. The device in accordance with claim 1, wherein said first circuit further contains its own energy source to power said time-counter.

18. The device in accordance with claim 1, wherein said first circuit further contains a display unit (22).

19. A device for determining the elapsed period of time since the first activation of a unit of equipment or components of a unit of equipment, particularly a unit of electrical equipment, comprising:

a time-counter;

an energy source for activating said time-counter;

a first circuit containing for establishing a connection between said energy source and said time-counter, wherein said first circuit contains an energy source to power said time-counter; and a switch-on element for activation of said first circuit, wherein said first circuit remains active after the end of said first activation of said unit of equipment and remains active throughout subsequent activations of said unit of equipment.

* * * * *